US007506851B1

(12) United States Patent
Tooze

(10) Patent No.: US 7,506,851 B1
(45) Date of Patent: Mar. 24, 2009

(54) RADIATOR MOUNTING SYSTEM

(76) Inventor: Nigel Tooze, 7A Thornyville Close, Oreston, Plymouth, DE (GB) PL9 7LE ( * ) Notice: Subject to any disclaimer, the term of this patent is extended or adjusted under 35 U.S.C. 154(b) by 0 days.

(21) Appl. No.: 11/670,649

(22) Filed: Feb. 2, 2007

(51) Int. Cl.
*F24H 9/06* (2006.01)

(52) U.S. Cl. ..... 248/233; 248/209; 248/232; 248/284.1; 248/291.1; 248/286.1; 237/70; 165/67

(58) Field of Classification Search ..... 248/209, 248/232, 233, 284.1, 291.1, 205.1, 286.1; 237/70, 79; 165/67
See application file for complete search history.

(56) References Cited

U.S. PATENT DOCUMENTS

| | | | | | |
|---|---|---|---|---|---|
| 876,714 | A | | 1/1908 | Harkins et al. | |
| 1,056,553 | A | * | 3/1913 | Kehm | 248/232 |
| 1,078,546 | A | * | 11/1913 | McCarty et al. | 248/232 |
| 1,175,707 | A | * | 3/1916 | Cleghorn et al. | 248/232 |
| 1,195,448 | A | * | 8/1916 | Dolechek | 248/295.11 |
| 1,224,916 | A | * | 5/1917 | Fowler | 248/232 |
| 1,480,456 | A | * | 1/1924 | Mallen | 248/233 |
| 1,625,473 | A | * | 4/1927 | Knox | 248/232 |
| 1,682,486 | A | * | 8/1928 | Conroy | 248/232 |
| 1,887,031 | A | * | 11/1932 | Lyon | 248/233 |
| 1,907,450 | A | * | 5/1933 | Shipp | 165/54 |
| 2,111,918 | A | * | 3/1938 | Moore | 248/232 |
| 3,327,775 | A | * | 6/1967 | Owen | 165/55 |
| 3,844,515 | A | * | 10/1974 | Knol | 248/71 |
| 3,966,156 | A | * | 6/1976 | Frischmann et al. | 248/201 |
| 4,455,710 | A | | 6/1984 | Johansen | |
| 5,139,080 | A | * | 8/1992 | Bolton et al. | 165/67 |
| 5,152,102 | A | | 10/1992 | La See | |
| 5,240,068 | A | * | 8/1993 | Tokutake | 165/67 |
| 5,255,471 | A | | 10/1993 | Shaw et al. | |
| 5,544,714 | A | * | 8/1996 | May et al. | 180/68.4 |
| D376,098 | S | | 12/1996 | Bucher | |
| 5,996,684 | A | * | 12/1999 | Clifton et al. | 165/67 |
| 6,269,520 | B1 | | 8/2001 | Kovalchek | |
| 6,607,022 | B1 | | 8/2003 | Davidson | |
| 6,966,355 | B2 | * | 11/2005 | Branham et al. | 165/41 |
| 7,036,617 | B2 | * | 5/2006 | Harada | 180/68.4 |
| 7,255,189 | B2 | * | 8/2007 | Kurtz, Jr. et al. | 180/68.4 |

* cited by examiner

*Primary Examiner*—J. Allen Shriver, II
*Assistant Examiner*—Michael McDuffie

(57) ABSTRACT

A radiator mounting system for allowing access to the area behind a wall mounted radiator includes a radiator that has a top pipe and a bottom pipe attached to and separated from each other. A pair of bracket assemblies mounted to the radiator pivotally couples the radiator to a vertical wall surfaces. The bracket assemblies are spaced from each other.

8 Claims, 3 Drawing Sheets

RADIATOR MOUNTING SYSTEM

BACKGROUND OF THE INVENTION

1. Field of the Invention

The present invention relates to radiator mounting devices and more particularly pertains to a new radiator mounting device for attaching a radiator to a wall in such a manner that allows the radiator to be selectively pivoted away from the wall surface.

2. Description of the Prior Art

The use of radiator mounting devices is known in the prior art. While these devices fulfill their respective, particular objectives and requirements, the need remains for a system that allows a radiator to be attached to wall surface in such a manner that permits selective pivoting of the radiator with respect to the wall surface. This will allow a person to work on, paint or clean a wall behind a radiator as well as provide more access to all portions of the radiator.

SUMMARY OF THE INVENTION

The present invention meets the needs presented above by generally comprising a radiator that includes a top pipe and a bottom pipe attached to and separated from each other. A pair of bracket assemblies mounted to the radiator pivotally couples the radiator to a vertical wall surface. The bracket assemblies are spaced from each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
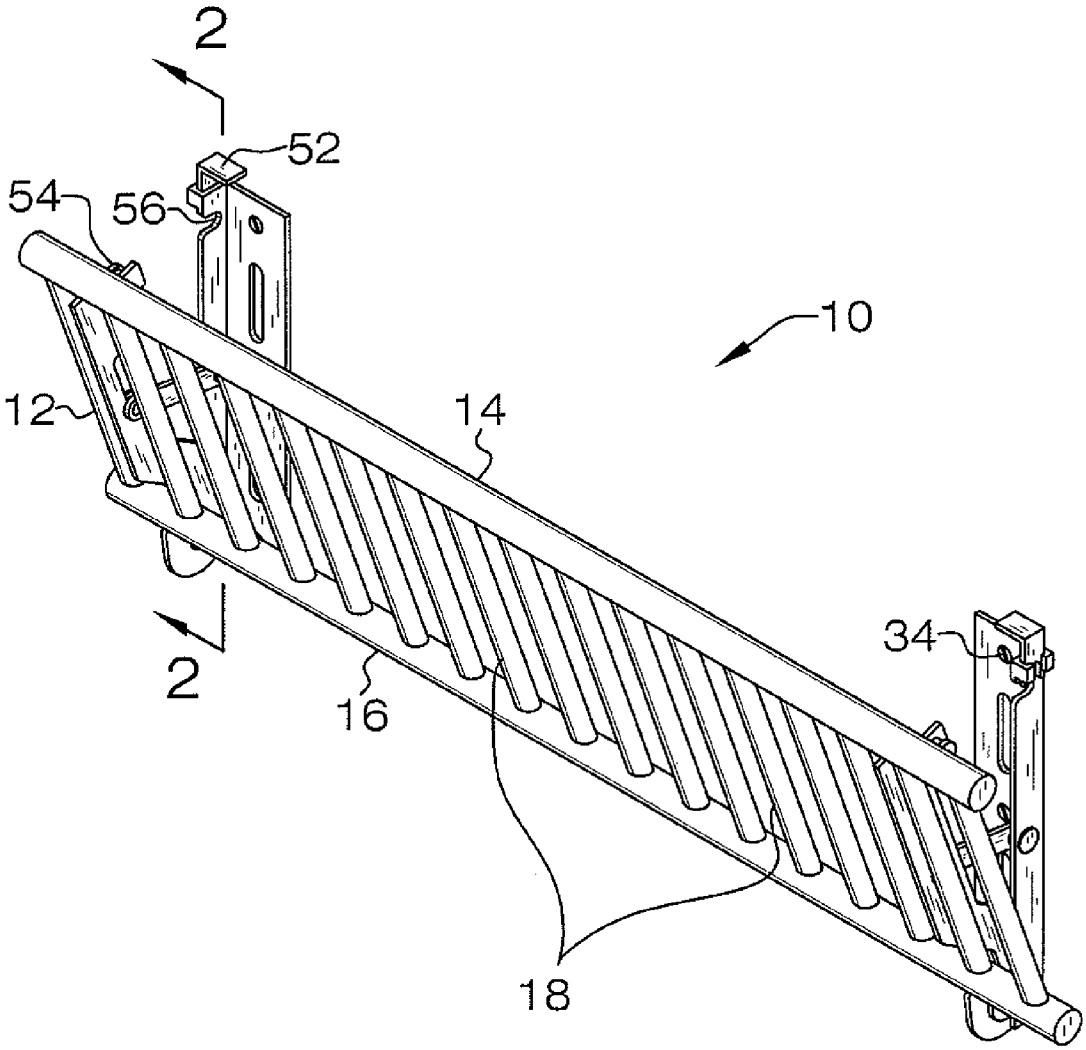
FIG. 1 is a perspective view of a radiator mounting system according to the present invention.
Figure 2:
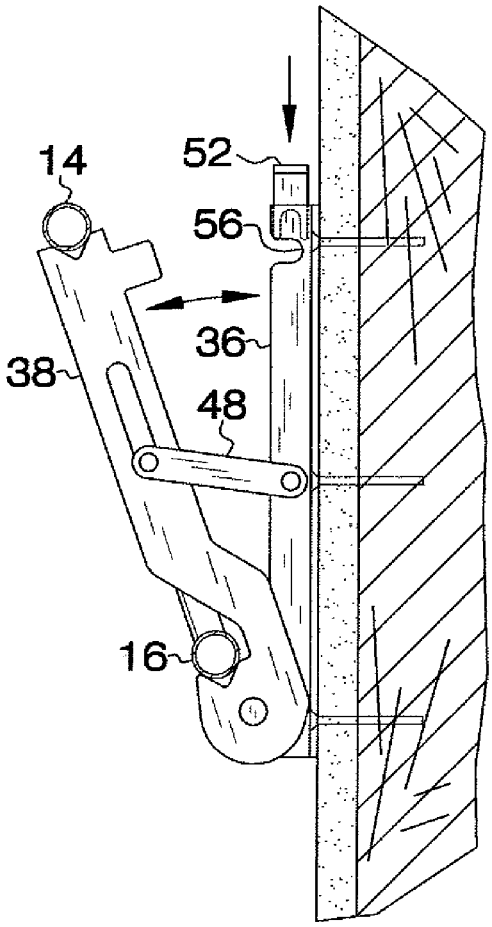
FIG. 2 is a cross-sectional view taken along line 2-2 of FIG. 1 of the present invention.

With reference now to the drawings, and in particular to FIGS. 1 through 6 thereof, a new radiator mounting device embodying the principles and concepts of the present invention and generally designated by the reference numeral 10 will be described.

As best illustrated in FIGS. 1 through 6, the radiator mounting system 10 generally comprises a radiator 12 that includes a top pipe 14 and a bottom pipe 16 attached to and separated from each other. A plurality of vertical pipes 18 extends between the top 14 and bottom 16 pipes.

A pair of bracket assemblies 20 is mounted to the radiator 12 and pivotally couples the radiator 12 to a vertical wall surface 22. The bracket assemblies 20 are spaced from each other. Each of the bracket assemblies 20 includes a plate 24 that has a first side 26, a second side 28, an outer edge 30 and an inner edge 32. At least one fastener 34 extends through the first plate 24 and into the wall surface 22 to securely abut the first side 26 to the wall surface 22. A second plate 36 is attached to and extends outwardly from the second side 28 of the first plate 24. The second plate 36 is vertically orientated and coextensive with the outer edge 30.

Figure 3:
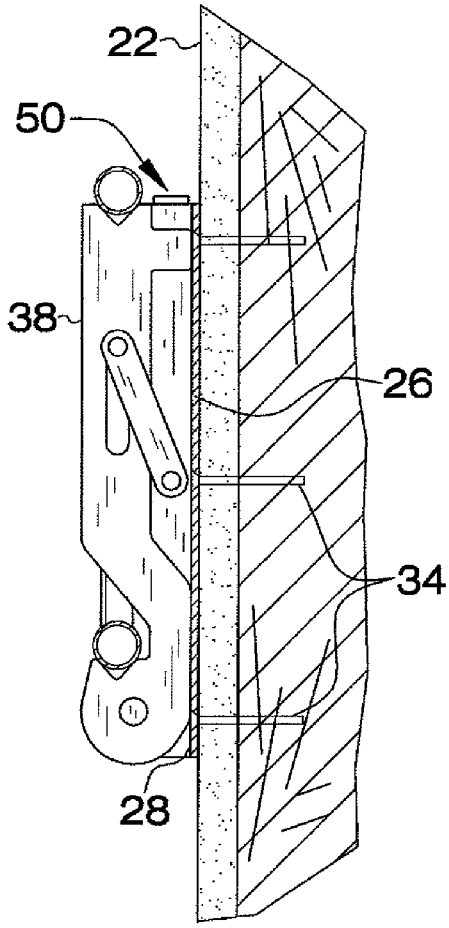
FIG. 3 is a cross-sectional view of the present invention.
Figure 4:
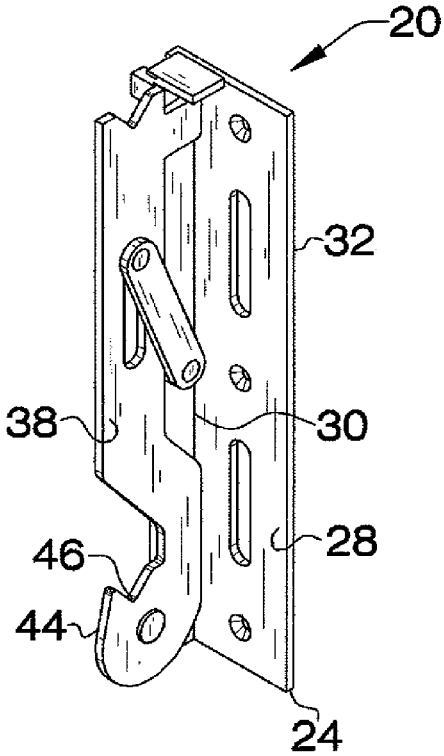
FIG. 4 is a right perspective view of the present invention.
Figure 5:
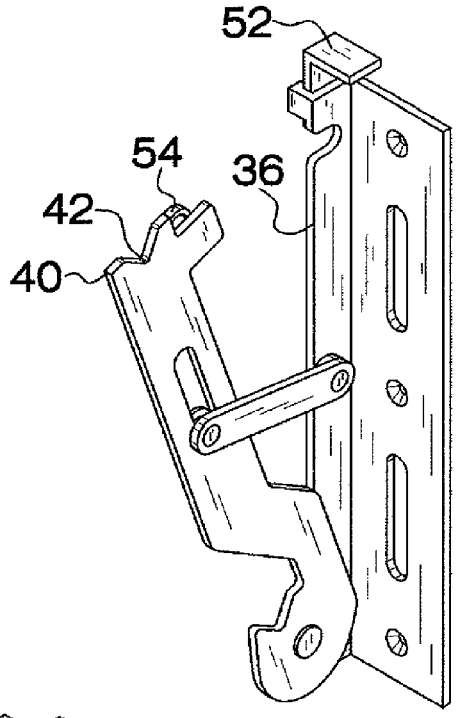
FIG. 5 is a right perspective view of the present invention.
Figure 6:
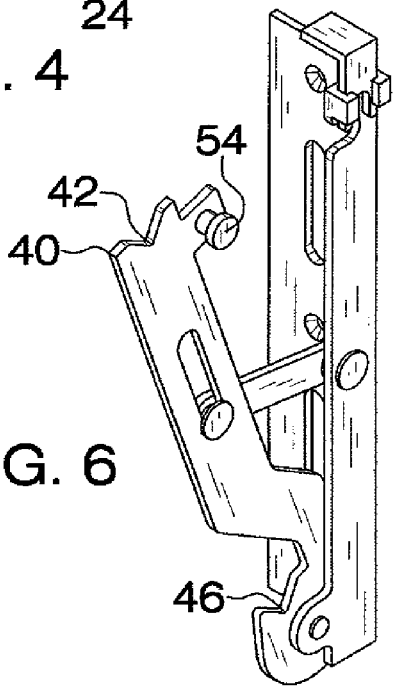
FIG. 6 is a left view of the present invention.

Each of the bracket assemblies 20 further includes a radiator mount 38 that is pivotally coupled to the second plate 36. The radiator mount 38 is positionable in an extended position or a closed position with respect to the second plate 36. The radiator 12 is mounted on the radiator mount 38. The radiator mount 38 is planar and orientate parallel to a plane of the second plate 36. The radiator 12 is vertically orientated when the radiator mount 38 is in the closed position as shown in FIG. 3. The radiator mount 38 has an upper edge 40 that has a notch 42 therein and receives the top pipe 14. The notch 42 is moved away from or toward the second plate 36 when the radiator 12 is pivoted with respect to the second plate 36. The radiator mount 38 has a front edge 44 that has a saddle 46 formed therein. The saddle 46 receives the bottom pipe 16. A support arm 48 is rotatably coupled to the second plate 36 and slidably coupled to the radiator mount 38. The support arm 48 supports the radiator mount 38 in an angled relationship with the second plate 36 when the radiator mount 38 is in the open positions.

The bracket assemblies 20 each further include a locking member 50 that is attached to the second plate 36 and is configured to secure the radiator mount 38 in the closed position. The locking member 50 includes a catch 52 slidably mounted on the second plate 36 and is selectively moveable into an engaged position and an unengaged position. A pin 54 is attached to the radiator mount 38 and is gripped by the locking member 50 when the catch 52 is in the engaged position to secure the radiator mount 36 in the closed position. The pin 54 extends into an indentation 56 in a forward edge of the second plate 36 when the radiator mount 38 is in the closed position.

In use, the radiator mounts 38 allow a person to mount the radiator 12 to the wall surface 22 while still allowing easy pivoting of the radiator 12 with respect to the wall surface 22. This will assist a person in cleaning behind the radiator 12 as well as allow a person to reach the entire radiator 12 easily when the radiator 12 is being repaired. Further, by allowing the radiator 12 to be pivoted away from the wall surface 22, the wall surface 22 may be cleaned, painted or worked on.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention.

I claim:

1. A radiator mounting system comprising:

a radiator including a top pipe and a bottom pipe attached to and separated from each other; and a pair of bracket assemblies mounted to said radiator and pivotally coupling said radiator to a vertical wall surface, said bracket assemblies being spaced from each other, each of said bracket assemblies including;

a plate having a first side, a second side, an outer edge and an inner edge, at least one fastener extending through said first plate and into the wall surface and abutting said first side to the wall surface;

a second plate being attached to and extending outwardly from said second side of said first plate, said second plate being vertically orientated;

a radiator mount being pivotally coupled to said second plate, said radiator mount being positionable in an extended position or a closed position with respect to said second plate, said radiator being mounted on said radiator mount, said radiator being vertically orientated when said radiator mount is in said closed position, radiator mount having an upper edge having a notch therein and receiving the top pipe, said notch being moved away from or toward said second plate when said radiator is pivoted with respect to said second plate, said radiator mount having a front edge having a saddle formed therein, said saddle receiving said bottom pipe.

2. The system according to claim 1, further including a support arm being rotatably coupled to said second plate and slidably coupled to said radiator mount.

3. The system according to claim 2, further including a locking member being attached to said second plate and being configured to secure said radiator mount in said closed position, said locking member including a catch slidably mounted on said second plate and selectively moveable into an engaged position and an unengaged position, a pin being attached to said radiator mount, said pin being gripped by said locking member when said locking member is in said engaged position to secure said radiator mount in said closed position.

4. The system according to claim 1, further including a locking member being attached to said second plate and being configured to secure said radiator mount in said closed position, said locking member including a catch slidably mounted on said second plate and selectively moveable into an engaged position and an unegaged position, a pin being attached to said radiator mount, said pin being gripped by said locking member when said locking member is in said engaged position to secure said radiator mount in said closed position.

5. A radiator mounting system comprising:

a radiator including a top pipe and a bottom pipe attached to and separated from each other;

a pair of bracket assemblies mounted to said radiator and pivotally coupling said radiator to a vertical wall surface, said bracket assemblies being spaced from each other, each of said bracket assemblies including;

a plate having a first side, a second side, an outer edge and an inner edge, at least one fastener extending through said first plate and into the wall surface and abutting said first side to the wall surface;

a second plate being attached to and extending outwardly from said second side of said first plate, said second plate being vertically orientated;

a radiator mount being pivotally coupled to said second plate, said radiator mount being positionable in an extended position or a closed position with respect to said second plate, said radiator being mounted on said radiator mount, said radiator being vertically orientated when said radiator mount is in said closed position, said radiator mount having an upper edge having a notch therein and receiving the top pipe, said notch being moved away from or toward said second plate when said radiator is pivoted with respect to said second plate, said radiator mount having a front edge having a saddle formed therein, said saddle receiving said bottom pipe;

a support arm being rotatably coupled to said second plate and slidably coupled to said radiator mount; and a locking member being attached to said second plate and being configured to secure said radiator mount in said closed position, said locking member including a catch slidably mounted on said second plate and selectively moveable into an engaged position and an unengaged position, a pin being attached to said radiator mount, said pin being gripped by said locking member when said locking member is in said engaged position to secure said radiator mounted in said closed position.

6. A radiator mounting system comprising:

a radiator including a top pipe and a bottom pipe attached to and separated from each other; and a pair of bracket assemblies mounted to said radiator and pivotally coupling said radiator to a vertical wall surface, said bracket assemblies being spaced from each other, each of said bracket assemblies including;

a plate having a first side, a second side, an outer edge and an inner edge, at least one fastener extending through said first plate and into the wall surface and abutting said first side to the wall surface;

a second plate being attached to and extending outwardly from said second side of said first plate, said second plate being vertically oriented;

a radiator mount being pivotally coupled to said second plate, said radiator mount being positionable in an extended position or a closed position with respect to said second plate, said radiator being mounted on said radiator mount, said radiator being vertically orientated when said radiator mount is in said closed position; and a support arm being rotatably coupled to said second plate and slidably coupled to said radiator mount.

7. The system according to claim 6, further including a locking member being attached to said second plate and being configured to secure said radiator mount in said closed position, said locking member including a catch slidably mounted on said second plate and selectively moveable into an engaged position and an unengaged position, a pin being attached to said radiator mount, said pin being gripped by said locking member when said locking member is in said engaged position to secure said radiator mount in said closed position.

8. The system according to claim 7, wherein said radiator mount has an upper edge having a notch therein and receiving the top pipe, said notch being moved away from or toward said second plate when said radiator is pivoted with respect to said second plate, said radiator mount having a front edge having a saddle formed therein, said saddle receiving said bottom pipe.

* * * * *